US009052667B2

(12) United States Patent
Yamaguchi et al.

(10) Patent No.: US 9,052,667 B2
(45) Date of Patent: Jun. 9, 2015

(54) IMAGE FORMING APPARATUS HAVING AN INTERLOCK SWITCH

(71) Applicant: Canon Kabushiki Kaisha, Tokyo (JP)

(72) Inventors: Takashi Yamaguchi, Kashiwa (JP); Takeshi Sekiya, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/926,978

(22) Filed: Jun. 25, 2013

(65) Prior Publication Data

US 2014/0003825 A1 Jan. 2, 2014

(30) Foreign Application Priority Data

Jun. 28, 2012 (JP) ..... 2012-145886

(51) Int. Cl.
*G03G 15/00* (2006.01)
*G03G 21/16* (2006.01)

(52) U.S. Cl.
CPC ..... *G03G 15/55* (2013.01); *G03G 15/80* (2013.01); *G03G 21/1633* (2013.01); *G03G 21/1652* (2013.01)

(58) Field of Classification Search
CPC ... G03G 15/55; G03G 15/80; G03G 21/1633; G03G 21/1652
USPC ..... 399/9, 21, 12, 111
See application file for complete search history.

(56) References Cited

U.S. PATENT DOCUMENTS 4,133,477 A * 1/1979 Marino et al. ..... 714/46
4,243,313 A * 1/1981 Masuda et al. ..... 399/19
5,745,662 A * 4/1998 Nagata et al. ..... 358/1.14
6,672,703 B2 * 1/2004 Kohno ..... 347/23
6,796,736 B1 * 9/2004 Shiraishi et al. ..... 400/692
7,761,022 B2 * 7/2010 Seo ..... 399/88
7,792,437 B2 * 9/2010 You ..... 399/9
8,063,584 B2 11/2011 Inukai
2002/0041775 A1 * 4/2002 Ishii ..... 399/124
2004/0184823 A1 * 9/2004 Fujii et al. ..... 399/9
2006/0204276 A1 * 9/2006 Takuwa ..... 399/110
2006/0210285 A1 * 9/2006 Nakazato ..... 399/13
2007/0104495 A1 * 5/2007 You ..... 399/9
2008/0019709 A1 * 1/2008 Eom ..... 399/9
2008/0124094 A1 * 5/2008 Eom ..... 399/9
2008/0199203 A1 * 8/2008 Seo ..... 399/88
2009/0003869 A1 * 1/2009 Takahashi ..... 399/75
2011/0182614 A1 * 7/2011 Onuma et al. ..... 399/110

FOREIGN PATENT DOCUMENTS

JP 10-268715 10/1998
JP 2004-148724 5/2004
JP 2007-140044 6/2007
JP 2009-198708 9/2009

* cited by examiner

*Primary Examiner* — G. M. Hyder
(74) *Attorney, Agent, or Firm* — Canon USA Inc IP Division

(57) ABSTRACT

An image forming apparatus comprising an image forming unit configured to form an image, a power supply unit configured to supply electric power to the image forming unit via a power supply line, a door configured to be opened for accessing the image forming unit, an output unit configured to output a signal indicating whether the door is open or closed, an interruption unit configured to interrupt electric power supplied by the power supply unit via the power supply line while the door is open, and a storage unit configured to store information indicating that the interruption unit interrupts electric power supplied by the power supply unit, wherein the signal comprises a first signal indicating that the door is open, and a second signal indicating that the door is closed, and wherein the storage unit clears the information after the second signal is output from the output unit.

9 Claims, 6 Drawing Sheets

IMAGE FORMING APPARATUS HAVING AN INTERLOCK SWITCH

BACKGROUND

1. Field

Aspects of the present invention generally relate to open/close sensing of a door for accessing an internal portion of an image forming apparatus.

2. Description of the Related Art

In general, an image forming apparatus such as a copier has a mechanism that allows a user to open a door of an apparatus to access an internal portion of the apparatus in a case of removing recording paper that has been stuck in a conveying path, a case of replacing a process cartridge, or other such case. Such an image forming apparatus includes an interlock mechanism for mechanically interrupting power supply to a driving mechanism such as a motor and a high-voltage circuit when the door is opened. Therefore, the driving mechanism stops operating when the door is opened even while the image forming apparatus is in operation, which can prevent an unexpected situation.

As a conventional technology relating to the above-mentioned interlock mechanism, there are known technologies disclosed in, for example, Japanese Patent Application Laid-Open Nos. 2009-198708 and 2007-140044. In those conventional technologies, the image forming apparatus includes a door open/close sensing sensor for sensing an open/closed state of the door and an engine controller (hereinafter referred to as "control portion"). The control portion senses that the door has been opened or closed by periodically examining an output from the door open/close sensing sensor. When sensing that the door has been opened, the control portion stops the driving mechanism, displays the open/closed state of the door on an operation portion operated by the user, and performs other such processing performed when the door is opened.

However, in the conventional technologies, the control portion can recognize the open/closed state of the door only at a timing at which the output signal output from the door open/close sensing sensor is examined by the control portion. This is because the control portion can only periodically examine a result of sensing performed by the door open/close sensing sensor. Therefore, the control portion may fail to recognize that the door has been opened if, for example, an open/close operation of the door is performed within a time interval shorter than a cycle period during which the control portion recognizes the open/closed state of the door.

In the image forming apparatus, the recording paper normally stops being conveyed when the door is opened during an image forming operation. After that, when the door is closed again, the operation portion issues a notification to instruct the user to remove the recording paper that has been stuck in the conveying path. When the recording paper is removed by the user, the image forming operation is restarted.

However, if the control portion cannot recognize that the door has been temporarily opened during the image forming operation, for example, the following problems occur.

That is, when the image forming apparatus starts the image forming operation, the control portion senses a BD signal (main-scanning synchronizing signal) in order to determine an irradiation start position in a main-scanning direction of a laser that is to irradiate a photosensitive drum. If the door is opened at this time, an interlock power source may be interrupted. In this case, the power supply to a scanner unit is stopped, which inhibits the control portion from detecting the BD signal.

If the BD signal cannot be sensed, the control portion examines the output from the door open/close sensing sensor. If the door is open, the control portion recognizes that the BD signal cannot be sensed because the door has been opened and the interlock power source has been interrupted, and discontinues the image forming operation.

However, there is a case where the door is closed even if the BD signal cannot be sensed. This is a case where the open/close operation for the door is performed before the control portion recognizes the open/closed state of the door as described above and the door is already closed when the control portion recognizes the open/closed state of the door. In this case, the control portion determines that the door is closed, and therefore erroneously recognizes that the BD signal can no longer be detected due to an occurrence of a failure in the scanner unit to stop the image forming operation. Therefore, even if the image forming apparatus is in a normal state, the user is erroneously informed that the failure has occurred in the image forming apparatus. Further, the image forming operation is stopped, which greatly impairs convenience of the user.

SUMMARY

According to an exemplary embodiment, there is provided an image forming apparatus comprising: an image forming unit configured to form an image; a power supply unit configured to supply electric power to the image forming unit via a power supply line; a door configured to be opened for accessing the image forming unit; an output unit configured to output, at intervals of a predetermined period, a signal indicating whether the door is open or closed; an interruption unit configured to interrupt electric power supplied by the power supply unit via the power supply line while the door is open; and a storage unit configured to store information indicating that the interruption unit interrupts electric power supplied by the power supply unit. The signal comprising a first signal indicating that the door is open, and a second signal indicating that the door is closed. The storage unit clears the information after the second signal is output from the output unit.

Further features of the present invention will become apparent from the following description of exemplary embodiments (with reference to the attached drawings).

DESCRIPTION OF THE EMBODIMENT

Figure 1:
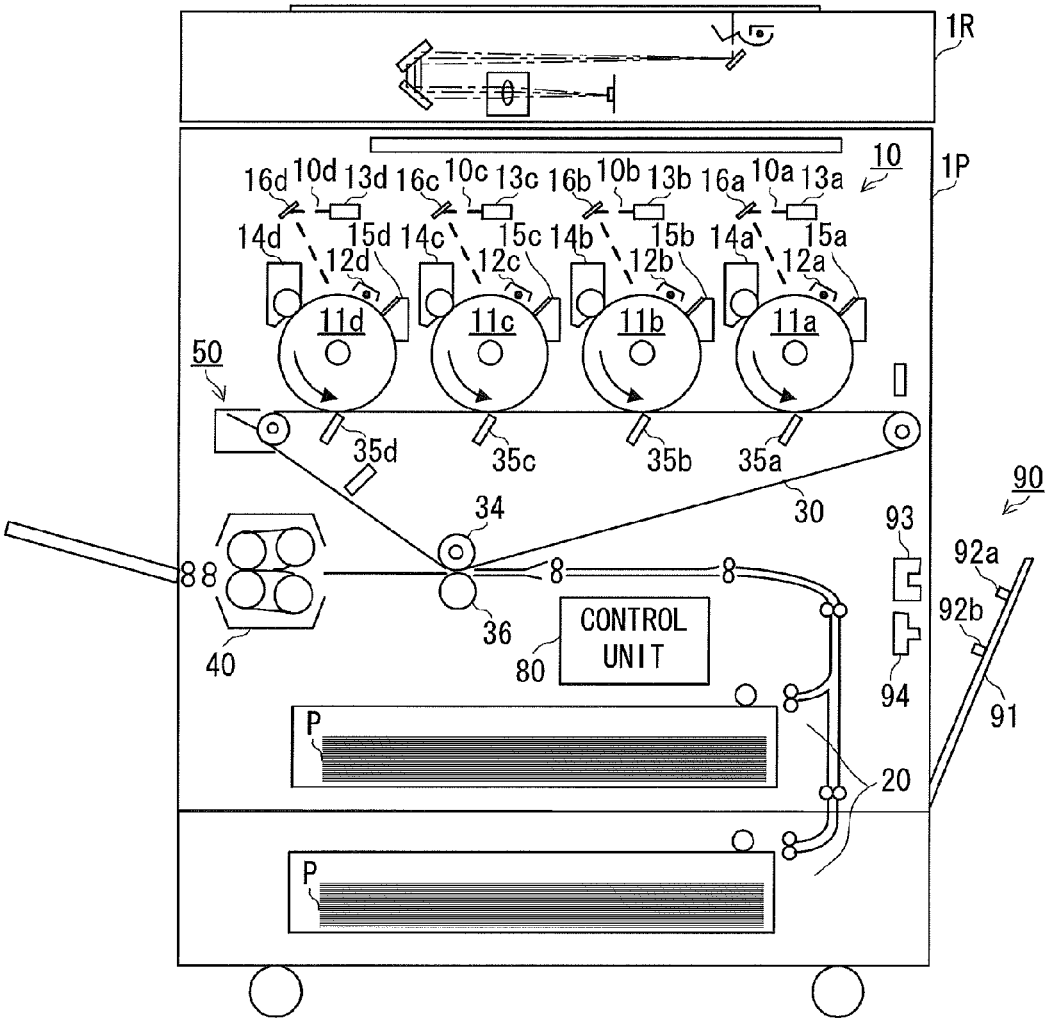
FIG. 1 is a sectional view illustrating an example of a schematic configuration of an image forming apparatus according to an embodiment.

FIG. 1 is a sectional view illustrating an example of a schematic configuration of an image forming apparatus according to an exemplary embodiment.

The image forming apparatus illustrated in FIG. 1 is an electrophotographic color image forming apparatus in which multiple image forming portions are arrayed in parallel. The image forming apparatus roughly includes an image reading section 1R and an image output section 1P. The image reading section 1R optically reads an original image, converts the original image into an electric signal, and transmits the electric signal to the image output section 1P.

The image output section 1P includes four image forming portions 10 (10*a* to 10*d*) provided in parallel with each other, for each forming a color image. In the image forming portions 10 (10*a* to 10*d*) includes photosensitive drums 11*a* to 11*d* serving as image bearing members. Photosensitive drums 11*a* to 11*d* are supported so as to be free to rotate about axes thereof, respectively, and are rotationally driven in the arrow directions. Primary chargers 12*a* to 12*d* are provided to parts opposed to outer peripheral surfaces of the photosensitive drums 11*a* to 11*d*, respectively. The primary chargers 12*a* to 12*d* impart charges having a uniform charge amount to front surfaces of the photosensitive drums 11*a* to 11*d*, respectively. Laser scanner units 13*a* to 13*d* expose light beams such as laser beams modulated based on an image signal received from the image reading section 1R to the outer peripheral surfaces of the photosensitive drums 11*a* to 11*d* via reflecting mirrors 16*a* to 16*d*, respectively. In this manner, electrostatic latent images are formed on the photosensitive drums 11*a* to 11*d*.

Developing devices 14*a* to 14*d* form visible images by causing developers to adhere to the electrostatic latent images. The visible images are transferred onto an intermediate transferring unit 30 by primary transferring devices 35*a* to 35*d*, respectively, and then transferred onto recording paper P conveyed from a sheet feeding unit 20 by secondary transferring devices 34 and 36. After that, the recording paper P has the transferred images heated and fixed by a fixing unit 40 and is delivered to an external portion of the image forming apparatus. The developers remaining on the photosensitive drums 11*a* to 11*d* are removed by cleaning devices 15*a* to 15*d*, respectively. Further, the developers remaining on the intermediate transferring unit 30 are removed by a cleaning unit 50.

The image output section 1P includes a control unit 80 and a door unit 90.

The control unit 80 controls an operation of the image forming apparatus. The control unit 80 is described later.

The door unit 90 includes a door 91 and projections 92*a* and 92*b* provided to the door 91. For example, when a paper jam occurs in a conveying path, a user can open the door 91 to remove recording paper that has been stuck in the conveying path. The door unit 90 further includes a door open/close sensing sensor 93 for sensing a open state in which the door 91 is open or a closed state in which the door 91 is closed, and an interlock switch 94 for interrupting power source supply to a device driven for image formation while the door 91 is open.

The door open/close sensing sensor 93 is, for example, a photo interrupter, and is actuated when the projection 92*a* of the door 91 leaves a recess of the door open/close sensing sensor 93.

The interlock switch 94 is brought into a non-energized state after the door open/close sensing sensor 93 is actuated, to interrupt the power source supply to the device. Further, the interlock switch 94 is brought into an energized state when it is pushed by the projection 92*b* of the door 91 before the door open/close sensing sensor 93 detects a closed state in which a door is closed, to restart the power source supply to the device. This stabilizes accuracy of sensing of an open/closed state of the door 91 performed by the door open/close sensing sensor 93.

Note that, in a case where multiple door units 90 are provided, the door open/close sensing sensor 93 and the interlock switch 94 are also provided for each of the door units 90.

Figure 2:
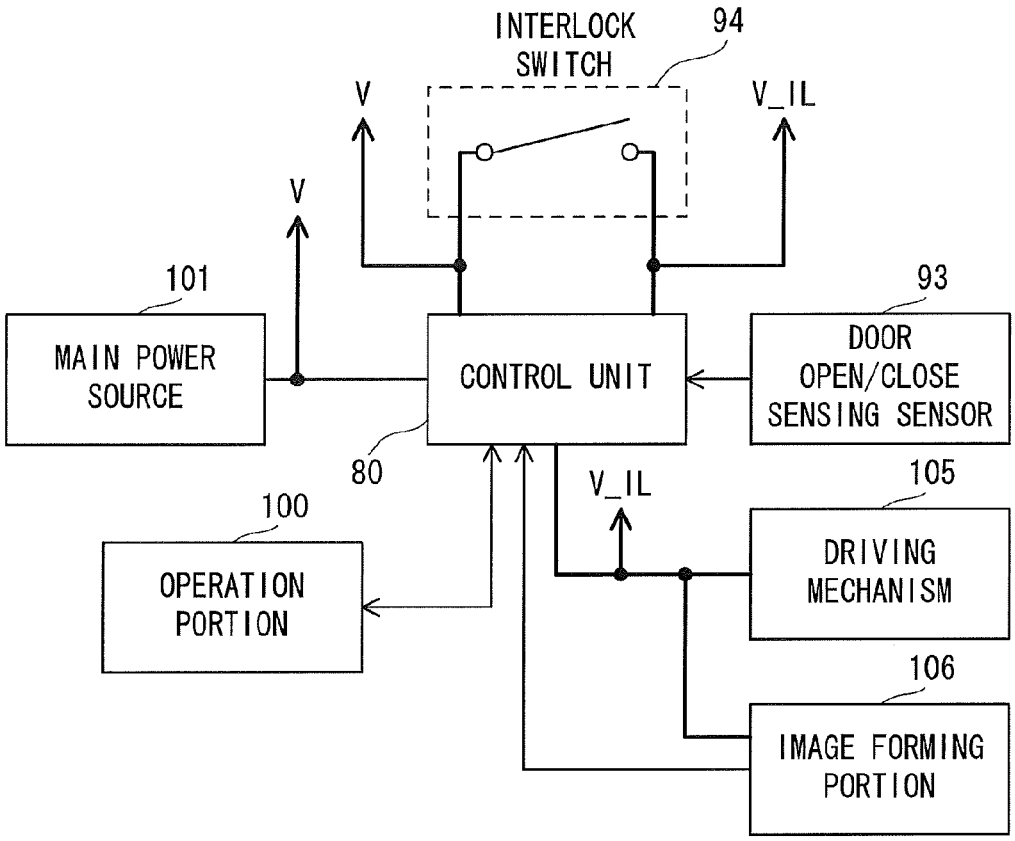
FIG. 2 is a diagram illustrating a functional configuration of the image forming apparatus which relates to door open/close sensing.

FIG. 2 illustrates functional blocks of a part of an operation of the control unit 80 which relates to door open/close sensing. Further, FIG. 3 is a circuit diagram illustrating detailed functions of the control unit 80.

Referring to FIG. 2, the control unit 80 is electrically connected to the door open/close sensing sensor 93, the interlock switch 94, a driving mechanism 105, an image forming portion 106, an operation portion 100, and a main power source 101. A power supply voltage V supplied from the main power source 101 passes through the control unit 80, and is then again input to the control unit 80 via the interlock switch 94 as an interlock power supply voltage V_IL. After that, the interlock power supply voltage V_IL is supplied to the driving mechanism 105 and the image forming portion 106. When the door 91 is opened, the interlock switch 94 is brought into the non-energized state, to interrupt the interlock power supply voltage V_IL. This interrupts the power source supply to the driving mechanism 105 and the image forming portion 106. In other words, the interlock switch 94 switch between energization or interruption of the interlock power supply voltage V_IL supplied through the control unit 80.

The driving mechanism 105 is a mechanism for driving various driving parts used for the image formation in synchronization with open/close of the door 91. The image forming portion 106 represents all component parts of the image output section 1P which are involved in image output. During the image formation, each time photosensitive drums 11*a* to 11*d* are scanned by one line, a BD signal is periodically output from the image forming portion 106 to the control unit 80.

Figure 3:
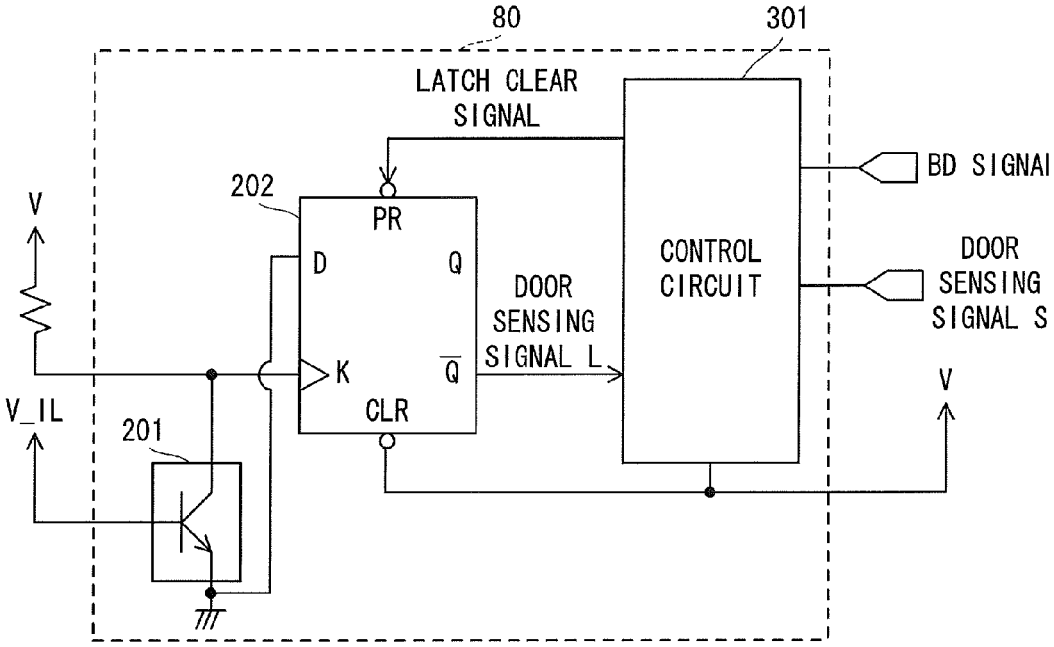
FIG. 3 is a circuit diagram of a control unit included in the image forming apparatus.

Referring to FIG. 3, the control unit 80 includes a control circuit 301 that operates based on the power supply voltage V supplied from the main power source 101.

The door open/close sensing sensor 93 outputs a door sensing signal S indicating the open/closed state of the door 91 to the control circuit 301 of the control unit 80. A signal level of the door sensing signal S is logical "H" when the door 91 is closed and logical "L" when the door 91 is open. Note that, a logical value is inverted through the intermediation of an inverter, and hence the signal level may be inverted. In any case, the door sensing signal S changes its signal level in accordance with an open/close operation for the door 91. The door sensing signal S corresponds to switching signal that depends on the open/closed state.

The control circuit 301 senses the door sensing signal S at regular cycle periods, and examines the open/closed state of the door 91 based on a change in the signal level. In this embodiment, a sensing cycle period is set to, for example, several tens of milliseconds. Note that, the sensing cycle period may be set appropriately. However, it is preferred that the sensing cycle period be a time interval longer than the cycle period for outputting the BD signal. This is because, if the sensing cycle period is shorter than the cycle period for outputting the BD signal, the BD signal may fail to be sensed within the sensing cycle period. In this case, as described later, the control unit 80 determines that a failure has occurred in the scanner unit.

If the interlock power supply voltage V_IL is interrupted when the door 91 is opened, a switching circuit 201 of FIG. 3 is turned off. This causes an input voltage of a K-terminal of a latch circuit 202 formed of a D-type flip-flop to change. When detecting the change in the input voltage of the K-terminal, the latch circuit 202 latches the change in the K-terminal, and outputs a door sensing signal L to the control circuit 301. The latching is performed by the latch circuit 202 independently of the sensing of the opening of the door 91 performed by the control circuit 301. The control circuit 301 determines, based on the door sensing signal S and the door sensing signal L, whether the door has been opened or not after the door is closed. After that, when the door 91 is closed and the signal level of the door sensing signal S recovers to logical "H", the control circuit 301 outputs a latch clear signal to the latch circuit 202. The latch circuit 202 discards information stored in a latch in response to the latch clear signal.

Figure 4:
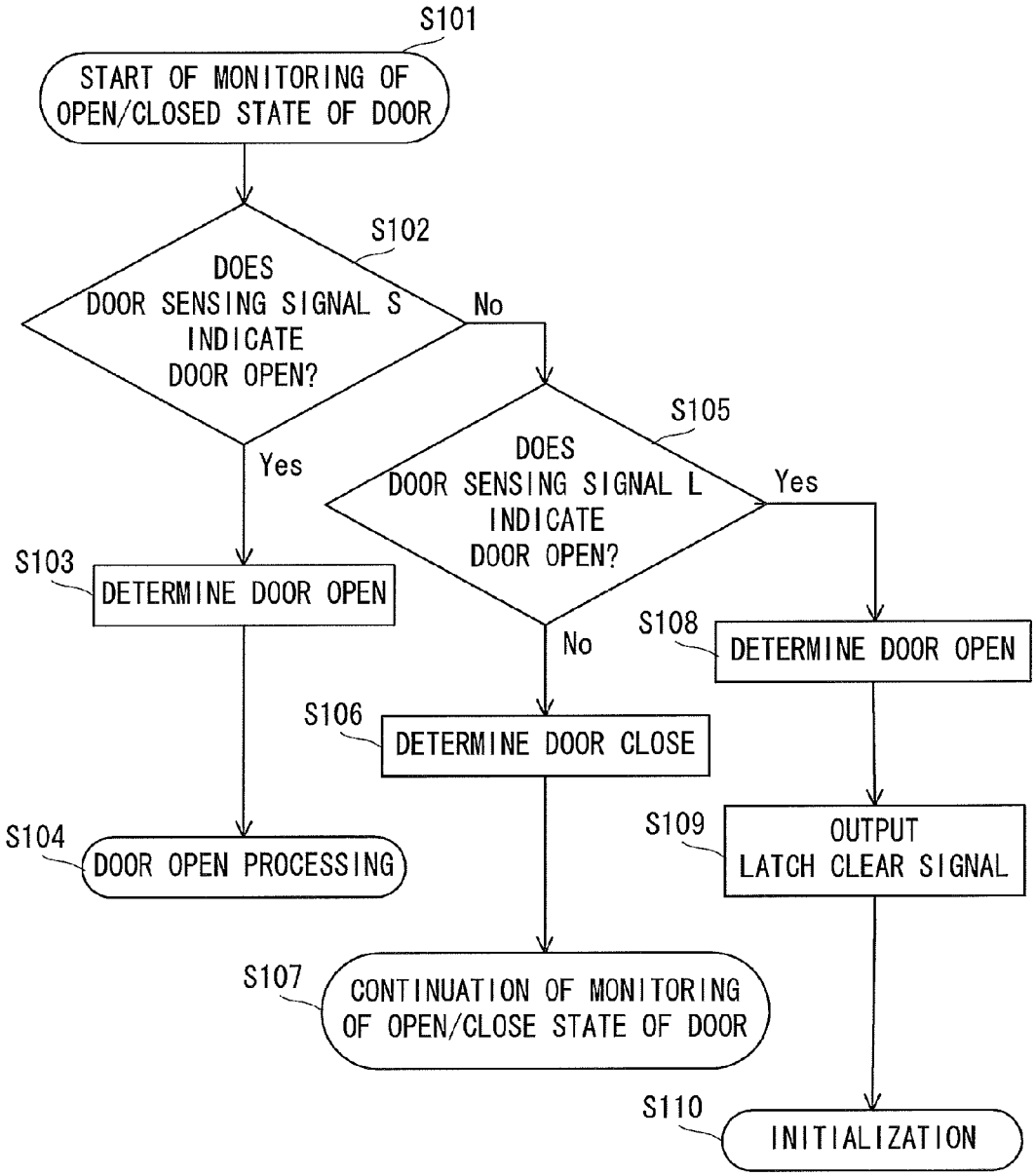
FIG. 4 is an explanatory diagram of a procedure for door open/close control performed by the control unit.

FIG. 4 illustrates an example of a procedure for door open/close control performed by the control unit 80 (control circuit 301).

When starting monitoring the open/closed state of the door (S101), the control circuit 301 first examines whether or not the door sensing signal S indicates the door open (is logical "L") based on the signal level thereof (S102). When the signal level of the door sensing signal S is logical "L", in other words, when the door open is sensed by the door open/close sensing sensor 93, the control circuit 301 determines the door open (that the door 91 is open) (S102: Yes, S103). Then, the control circuit 301 carries out door open processing (S104). The door open processing is processing in which the control circuit 301 stops an operation of the driving mechanism 105 and outputs alert information indicating that the door is open to the operation portion 100.

If neither the signal level of the door sensing signal S nor the signal level of the door sensing signal L indicates the door open (both of which are logical "H") (S102: No and S105: No), the control circuit 301 determines the door close (that the door 91 is closed), and continues to monitor the open/closed state of the door (S106 and S107). If the door sensing signal S does not indicate the door open (is logical "H") while the door sensing signal L indicates the door open (is logical "L") (S102: No and S105: Yes), the control circuit 301 determines the door close based on the signal level of the door sensing signal S (logical "H"). Further, the control circuit 301 determines based on the signal level of the door sensing signal L (logical "L") that the door has been temporarily opened to interrupt the interlock power supply voltage V_IL (S108). In this case, the control circuit 301 outputs the latch clear signal to the latch circuit 202 (S109). After that, the control unit 80 initializes the image forming apparatus (S110), and shifts to a standby state or restarts an image forming operation.

Figure 5:
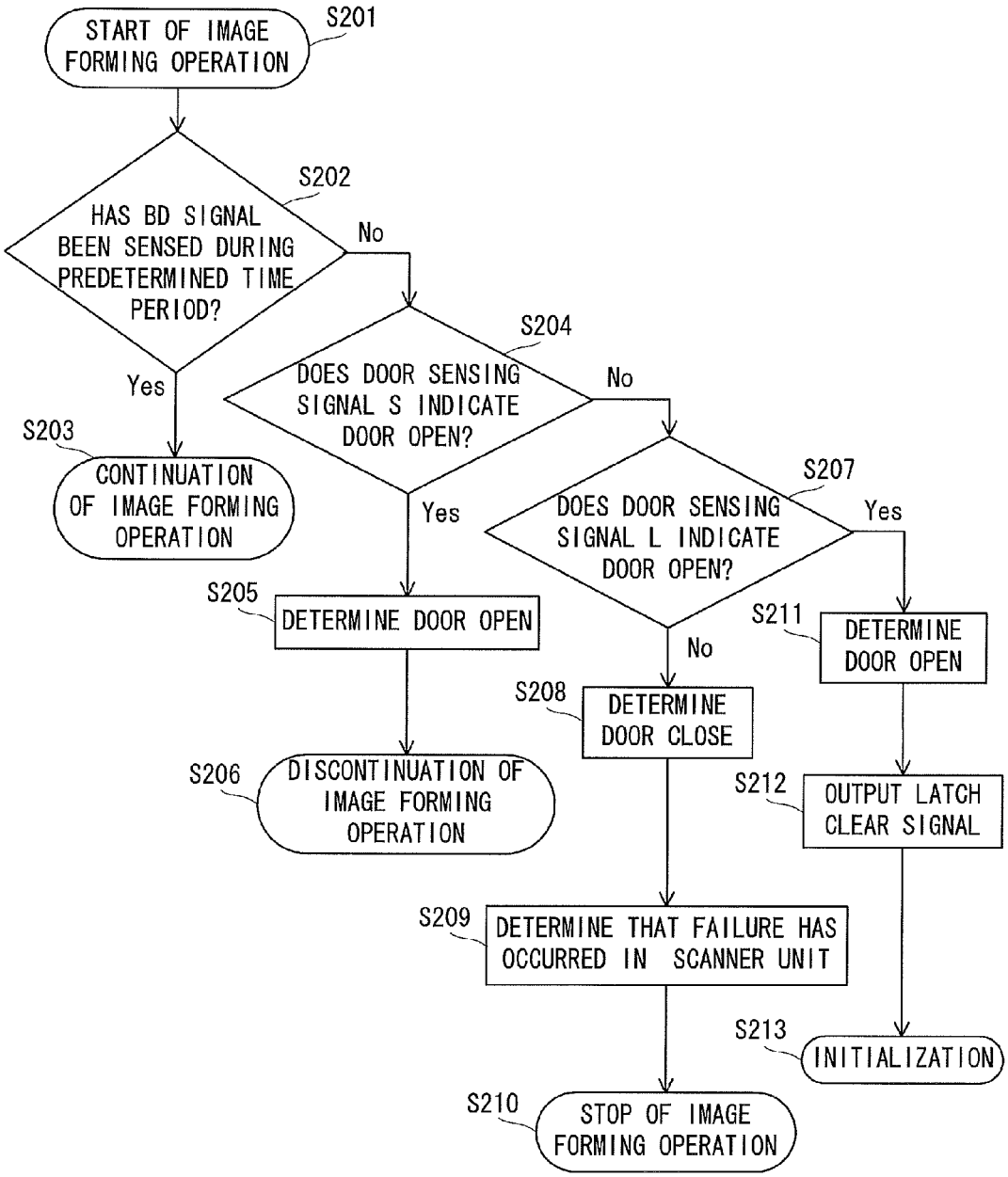
FIG. 5 is an explanatory diagram of a procedure for control performed by the control unit when a BD signal is not detected during an image forming operation.

FIG. 5 is a diagram of a procedure for an operation performed by the control unit 80 (control circuit 301) when the BD signal is not detected during the image forming operation.

When the image forming operation is started (S201), the control circuit 301 monitors whether or not the BD signal has been sensed during a predetermined time period (S202). If the BD signal is sensed, the control circuit 301 continues the image forming operation (S202: Yes and S203).

If the BD signal is not sensed after the image forming operation is started before the predetermined time period has elapsed, the control circuit 301 examines whether or not the door sensing signal S indicates the door open (is logical "L") (whether or not the door 91 is open) (S202: No and S204). If the signal level of the door sensing signal S is logical "L", in other words, indicates the door open, the control circuit 301 determines that the BD signal can no longer be detected because the door 91 is open (S204: Yes and S205). Then, the control circuit 301 carries out the door open processing to discontinue the image forming operation (S206).

If the door sensing signal S does not indicate the door open (is logical "H"), the control circuit 301 examines whether or not the door sensing signal L indicates the door open (is logical "L") (S204: No, S207). If the signal level of the door sensing signal L is logical "H", in other words, does not indicate the door open (S207: No), the control circuit 301 determines that the failure has occurred in the scanner unit (S208 and S209). In this case, the control circuit 301 generates alert information indicating that a failure has occurred in the image forming apparatus, and notifies the operation portion 100 thereof. Further, the control circuit 301 stops the image forming apparatus so as to inhibit the image forming operation from being performed.

On the other hand, if the door sensing signal S does not indicate the door open (is logical "H") while the door sensing signal L indicates the door open (is logical "L") (S207: Yes), the control circuit 301 determines the door open causing no harm in performing the image formation (S211). In this case, the control circuit 301 outputs the latch clear signal to the latch circuit 202 (S212). When the latch circuit 202 receives the latch clear signal, the control unit 80 initializes the image forming apparatus (S213). Therefore, the image forming operation is restarted.

Figure 6:
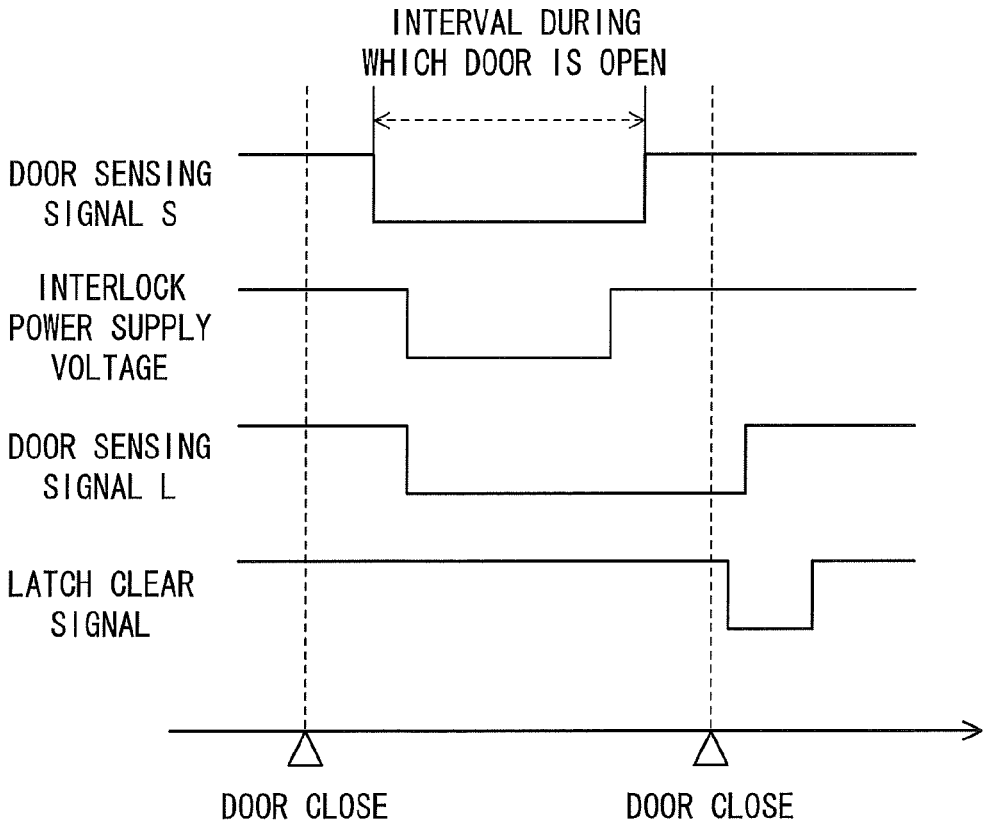
FIG. 6 is a timing chart observed when an open/close operation for the door is performed within a time period shorter than a cycle period of sensing of an open/closed state of a door.

The above-mentioned procedure for the door open/close sensing performed by the control circuit 301 is described in more detail with reference to FIG. 6. FIG. 6 is a timing chart observed when the open/close operation for the door 91 is performed within the time interval shorter than each of the cycle periods at which the control circuit 301 senses the open/closed state of the door.

The control circuit 301 cannot sense the open/closed state of the door based on the door sensing signal S and the door sensing signal L at a first timing. This is because both the signal levels of the door sensing signal S and the door sensing signal L are logical "H". At this time, the control circuit 301 recognizes the closed state as the door close.

After that, the opening of the door 91 causes the signal level of the door sensing signal S to change to logical "L" indicating the door open. Further, the interlock power supply voltage V_IL is interrupted, and hence the switching circuit 201 of FIG. 3 is turned off to cause the input voltage of the K-terminal of the latch circuit 202 to change from logical "H" to logical "L". When detecting the change in the input voltage of the K-terminal, the latch circuit 202 outputs the door sensing signal L (door open information) of logical "L" to the control circuit 301. The door sensing signal L maintains logical "L" unless the control circuit 301 outputs the latch clear signal to the latch circuit 202.

Because the door 91 is already closed at a second timing after the first timing, the signal level of the door sensing signal S has recovered to logical "H", and the interlock power supply voltage V_IL has also recovered to the normal level. However, at this time point, the door sensing signal L maintains a logical "L" level, and hence the control circuit 301 can recognize that the door 91 has been opened temporarily.

In this manner, in the image forming apparatus according to this embodiment, the latch circuit 202 of the control unit 80 latches the door open information, in other words, information indicating that the interlock power supply voltage V_IL has been interrupted due to the opening of the door 91, until the control circuit 301 recognizes the information. Then, after the recognition, the door open information is discarded. Therefore, it is possible to sense, by using simple component parts, the fact that even if the door 91 of the casing of the apparatus is closed, the door 91 has been opened temporarily to interrupt the power source supply to the device to which the power source supply is performed for the image formation.

Note that, the present embodiment has been described by taking the driving mechanism 105 as an example of the device to which the power source supply is performed for the image formation. The present embodiment can also be applied to all parts, for example, the image forming portion 106, the power source supply to which is interrupted when the door 91 is opened.

Further, this embodiment has been described by taking the BD signal as an example of the signal output during the image formation, but another signal indicating an operating state may be used. The signal output during image formation, for example, may be a signal periodically output synchronizing with the rotation of a motor which drives a photosensitive drums 11 or the intermediate transferring unit 30.

In addition, in this embodiment, the door sensing signal L is generated, and the switching circuit 201 and the latch circuit 202 are used as means for retaining the door sensing signal L, but the same function can be realized by using a memory.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-145886, filed Jun. 28, 2012, which is hereby incorporated by reference herein in its entirety.

What is claimed is:

1. An image forming apparatus comprising:

an image forming unit configured to form an image;

a power supply unit configured to supply electric power to the image forming unit via a power supply line;

a door configured to be opened for accessing the image forming unit;

an output unit configured to output a signal indicating whether the door is open or closed;

a control unit configured to determine the signal output from the output unit at a predetermined sensing cycle period;

an interruption unit configured to interrupt electric power supplied by the power supply unit via the power supply line while the door is open, the interruption unit comprising a switching contact located on the power supply line, the switching contact opens to interrupt electric power supplied by the power supply unit when the door is opened; and a storage unit configured to store information indicating that the interruption unit interrupts electric power supplied by the power supply unit, wherein the signal comprises a first signal indicating that the door is open and a second signal indicating that the door is closed, and wherein the control unit clears the information after the second signal is output from the output unit, wherein the switching contact is opened after the first signal is output from the output unit and is closed before the second signal is output from the output unit.

2. The image forming apparatus according to claim 1, wherein the control unit determines that the door is open if the first signal is output from the output unit.

3. The image forming apparatus according to claim 2, wherein the control unit determines that the door is closed if (i) the second signal is output from the output unit and (ii) the information has not been stored in the storage unit.

4. The image forming apparatus according to claim 1, further comprising an informing unit configured to inform that the door is open if the first signal is output from the output unit.

5. The image forming apparatus according to claim 1, wherein the image forming unit stops an image forming operation for forming the image if the first signal is output from the output unit.

6. An image forming apparatus comprising:

an image forming unit configured to form an image;

a power supply unit configured to supply electric power to the image forming unit via a power supply line;

a door configured to be opened for accessing the image forming unit;

an output unit configured to output a signal indicating whether the door is open or closed;

a control unit configured to determine the signal output from the output unit at a predetermined sensing cycle period;

an interruption unit configured to interrupt electric power supplied by the power supply unit via the power supply line while the door is open; and a storage unit configured to store information indicating that the interruption unit interrupts electric power supplied by the power supply unit, wherein the signal comprises a first signal indicating that the door is open and a second signal indicating that the door is closed, and wherein the control unit clears the information after the second signal is output from the output unit, wherein the control unit determines that the door is open if the first signal is output from the output unit, and wherein the control unit determines that the door has been opened in a case where the information has been stored in the storage unit even if the second signal is output from the output unit.

7. An image forming apparatus comprising:

an image forming unit configured to form an image;

a power supply unit configured to supply electric power to the image forming unit via a power supply line;

a door configured to be opened for accessing the image forming unit;

an output unit configured to output a signal indicating whether the door is open or closed;

a control unit configured to determine the signal output from the output unit at a predetermined sensing cycle period;

an interruption unit configured to interrupt electric power supplied by the power supply unit via the power supply line while the door is open; and a storage unit configured to store information indicating that the interruption unit interrupts electric power supplied by the power supply unit, wherein the signal comprises a first signal indicating that the door is open and a second signal indicating that the door is closed, and wherein the control unit clears the information after the second signal is output from the output unit, wherein the control unit determines that the door is open if the first signal is output from the output unit, and wherein the image forming unit outputs, at intervals of an another predetermined period that is shorter than the predetermined period, a predetermined signal, and wherein the control unit determines that an error condition with the image forming unit if (i) the image forming unit fails to output the predetermined signal at the intervals of the another predetermined period, (ii) the second signal is output from the output unit, and (iii) the information has been not stored in the storage unit.

8. An image forming apparatus comprising:

an image forming unit configured to form an image;

a power supply unit configured to supply electric power to the image forming unit via a power supply line;

a door configured to be opened for accessing the image forming unit;

an output unit configured to output a signal indicating whether the door is open or closed;

a control unit configured to determine the signal output from the output unit at a predetermined sensing cycle period;

an interruption unit configured to interrupt electric power supplied by the power supply unit via the power supply line while the door is open;

a storage unit configured to store information indicating that the interruption unit interrupts electric power supplied by the power supply unit; and an informing unit configured to inform that the door is open if the first signal is output from the output unit;

wherein the signal comprises a first signal indicating that the door is open and a second signal indicating that the door is closed, and wherein the control unit clears the information after the second signal is output from the output unit, wherein the control unit determines that the door is open if the first signal is output from the output unit, wherein the image forming unit outputs, at intervals of an another predetermined period that is shorter than the predetermined period, a predetermined signal, and wherein the informing unit informs that an error condition has occurred with the image forming unit if (i) the image forming unit fails to output the predetermined signal at the intervals of the another predetermined period, (ii) the second signal is output from the output unit, and (iii) the information has not been stored in the storage unit.

9. An image forming apparatus comprising:

an image forming unit configured to form an image;

a power supply unit configured to supply electric power to the image forming unit via a power supply line;

a door configured to be opened for accessing the image forming unit;

an output unit configured to output a signal indicating whether the door is open or closed;

a control unit configured to determine the signal output from the output unit at a predetermined sensing cycle period;

an interruption unit configured to interrupt electric power supplied by the power supply unit via the power supply line while the door is open; and a storage unit configured to store information indicating that the interruption unit interrupts electric power supplied by the power supply unit, wherein the signal comprises a first signal indicating that the door is open and a second signal indicating that the door is closed, wherein the control unit clears the information after the second signal is output from the output unit, and wherein the image forming unit outputs, at intervals of an another predetermined period that is shorter than the predetermined period, to a predetermined signal, and wherein the image forming unit discontinues an image forming operation for forming the image if (i) the image forming unit fails to output the predetermined signal at the intervals of the another predetermined period, (ii) the second signal is output from the output unit, and (iii) the information has not been stored in the storage unit.

* * * * *